US007204172B2

(12) United States Patent
Stewart

(10) Patent No.: US 7,204,172 B2
(45) Date of Patent: Apr. 17, 2007

(54) STOPPER REMOVING TOOL

(76) Inventor: Bryce Leslie Stewart, 16 Fahey Avenue, Mt. Maunganul, Tauranga 3002 (NZ)

( * ) Notice: Subject to any disclaimer, the term of this patent is extended or adjusted under 35 U.S.C. 154(b) by 0 days.

(21) Appl. No.: 10/558,576

(22) PCT Filed: Aug. 30, 2004

(86) PCT No.: PCT/NZ2004/000203

§ 371 (c)(1),
(2), (4) Date: Nov. 29, 2005

(87) PCT Pub. No.: WO2005/028356

PCT Pub. Date: Mar. 31, 2005

(65) Prior Publication Data

US 2006/0254390 A1 Nov. 16, 2006

(30) Foreign Application Priority Data

Sep. 25, 2003 (NZ) ..... 528539

(51) Int. Cl.
*B67B 7/14* (2006.01)
*B67B 7/18* (2006.01)

(52) U.S. Cl. ..... 81/3.4; 81/3.07; 81/3.44; 81/3.48

(58) Field of Classification Search ..... 81/3.07, 81/3.4, 3.44, 3.48
See application file for complete search history.

(56) References Cited

U.S. PATENT DOCUMENTS 3,722,327 A * 3/1973 Strassel ..... 7/156
5,862,720 A * 1/1999 McNellis ..... 81/3.09

* cited by examiner

*Primary Examiner*—Lee D. Wilson
*Assistant Examiner*—Shantese McDonald
(74) *Attorney, Agent, or Firm*—Galbreath Law Offices, P.C.; John A. Galbreath

(57) ABSTRACT

A hand tool (1) for removing a stopper from a pressurized vessel (eg a bottle of sparkling wine) of a type where the stopper is retained by a wire cage, the wire cage including a wire band at or adjacent a neck ring on the vessel, the wire band being secured by a twisted portion terminating in a wire eye, the tool (1) including: a pair of elongate members (20*a*, 20*b*) pivotally connected together, each member having a handle portion (21) and a jaw portion (22); a stopper-gripping portion comprising a tooth (27) on an inner side of each jaw portion (22), the stopper-gripping portions (27, 27), in use, gripping the stopper therebetween and cooperating to permit relative pivoting movement between the members (20*a*, 20*b*) and the stopper substantially about a fulcrum axis defined by and extending between the two stopper-gripping portions (27,27), and a protrusion (24) at or adjacent at least one of the member (20*a*, 20*b*) and adapted to be received in the wire eye when the stopper-gripping portions (27, 27) are engaged with the stopper.

14 Claims, 6 Drawing Sheets

STOPPER REMOVING TOOL

TECHNICAL FIELD

The present invention relates to a tool for removing stoppers. A preferred form of the invention relates to a tool for removing stoppers retained by a wire cage in pressurized vessels, for example in bottles of sparkling wine.

BACKGROUND

Sparkling wines, such as Champagne wines or the like, are closed by way of a cork or plastic stopper held by a wire cage to resist the high internal pressure. The wire cage covers the top of the stopper and is fixed on a ring provided on the neck of the bottle. The wire cage generally includes one or more wire strands twisted and bent to form a crown from which a number of legs protrude. Each leg presents a loop at its end into which passes a band that is secured below the neck ring of the bottle by a twisted portion terminating in a wire eye. The wire cage is typically covered by a foil cover.

To open the bottle, the foil cover is removed, then the wire eye grasped to untwist and release the band and so allow the wire cage to be removed. Some care is required after removal of the wire cage to avoid having the stopper suddenly pop out of the bottle, possibly causing damage or injury. Due to the low weight if the stopper and the very high pressure within the bottle, ejected stoppers can travel at high speeds and are dangerous projectiles, especially if allowed to escape unexpectedly. Finally, the stopper is manually grasped and drawn out, or twisted to break the static friction and allow the internal pressure to drive it out. Grasping the stopper, however, often requires reasonable strength or the use of some type of tool to get better purchase on the stopper.

Because opening a bottle of sparkling wine often marks a significant occasion, it is a task that should be achieved quickly, simply, and safely. Various tools are known in the prior art for gripping the stopper or prying the stopper out once the wire cage has been removed. Removing the wire cage manually, however, is somewhat time consuming and can be troublesome. Particularly at large gatherings and in commercial premises, there is a need to rapidly open bottles quickly and efficiently.

It is an object of at least form of the present invention to go at least some way towards providing a tool which can be used to remove stoppers from pressurized containers, for example sparkling wine bottles, or to at least provide the public with a useful choice. Preferably the tool is such that it enables one to achieve this in a reasonably quick, safe, and efficient manner.

If and when used herein, the word "comprises" is intended to convey "includes, but is not limited to", and its derivatives have a corresponding meaning.

Further aspects and advantages of the present invention will become apparent from the ensuing description which is given by way of example only.

SUMMARY OF THE INVENTION

In one aspect the present invention provides a hand tool for removing a stopper from a pressurised vessel of a type where the stopper is retained by a wire cage, the wire cage including a wire band engaging a neck ring on the vessel, the wire band being secured by a twisted portion terminating in a wire eye, the tool including:

a pair of elongate members pivotally connected together, each member having a handle portion and a jaw portion;

a stopper-gripping portion on an inner side of each jaw portion, the stopper-gripping portions, in use, being suitable for gripping the stopper therebetween and cooperating to permit relative pivoting movement between the members and the stopper substantially about a fulcrum axis defined by and extending between the two stopper-gripping portions, and a protrusion at or adjacent, and preferably fixed to, at least one of the members and adapted so that it can be received in the wire eye when the stopper-gripping portions are engaged with the stopper.

Preferably the protrusion is offset from the stopper-gripping portions such that with the protrusion received in the wire eye and the stopper-gripping portions engaged with the stopper, pivoting the tool about the stopper-gripping portions tensions the twisted portion, by which action the wire band is either broken or forced over the neck ring, thus releasing the wire band while the stopper-gripping portions remain engaged with the stopper and thereby allowing the wire cage and stopper to be subsequently removed together simultaneously.

Preferably each stopper-gripping portion is integrally formed with its respective jaw portion. Optionally each stopper-gripping portion is attached to the jaw portion for pivoting relative to the jaw portion.

Preferably each stopper-gripping portion comprises an aperture, indentation, projection, pin, tooth or the like having a stopper-engaging surface which is symmetrical about an inwardly-directed axis. In this manner when the stopper-engaging surface is pressed into engagement with the stopper, the relative pivoting movement is permitted. While axisymmetric teeth are preferred, a stopper-gripping portion in the form of a circular aperture, for example, has also been found satisfactory since when firmly grasped by the jaw portions the relatively soft stopper bulges into the aperture to provide a fulcrum.

The tool may work on a lever-type principle whereby the head of the stopper and the stopper-gripping portions cooperate to provide the fulcrum, the offset of the handle from the stopper-gripping portions provides a first lever arm and the offset of the hook from the stopper-gripping portion provides a second lever arm. The fulcrum axis extends between the two stopper-gripping portions substantially perpendicular to an elongate axis of the handle portions. The handle portions and protrusion are preferably offset on opposing sides of the stopper-gripping portions such that pressing down on the handle portions raises the protrusion. Relative pivoting movement between the tool and the stopper is important to the preferred mode of operation of the tool, since firmly holding the stopper and relying upon deflection of the stopper to provide the fulcrum is likely to rupture the stopper, particularly one made of cork.

Preferably the protrusion is elongate and extends or may be extended substantially parallel to an elongate axis of the handles. The protrusion is curved or hook-shaped, and for ease of reference is hereafter referred to as a hook. The end of the hook is preferably pointed to allow it to pierce a foil cap covering the wire and stopper and be pressed into the eye.

The preferred embodiment of the tool may further include a positioning abutment having an abutment surface for abutting the end face of the stopper. The positioning abutment may be fixed to at least one of the jaw portions, or alternatively may be formed as a separate component. The function of the positioning abutment is twofold: firstly, it assists in correctly locating the stopper-gripping portion on the stopper. Secondly, it helps retain the cork in the tool during the removal process to further prevent the stopper from becoming a projectile.

Preferably each member is substantially rigid and formed in one piece with a handle portion and a jaw portion at opposing ends thereof. The ends of the pair of members are preferably pivotally connected and the protrusion is fixed at or adjacent an end of at least one of the jaw portions. Optionally the projection is pivotally mounted for movement between an extended and retracted position.

In another aspect the present invention provides a hand tool for removing a stopper from a sparkling wine bottle where the stopper is retained by a wire cage, the wire cage including a wire band engaging a neck ring on the vessel, the wire band being secured by a twisted portion terminating in a wire eye, the tool allowing the wire band to be released while maintaining gripping engagement with the stopper, the tool including:

a pair of elongate members pivotally connected together, each member being substantially rigid and formed in one piece with a handle portion and a jaw portion at opposing ends thereof, each of the jaw portions having one stopper-gripping tooth integrally formed therewith and at least one of the jaw portions having a protrusion integrally formed therewith, wherein each stopper-gripping tooth is axisymmetric and formed on an inner side of each jaw portion for engagement with the stopper, the two stopper-gripping teeth cooperating to permit relative pivoting movement between the jaw portions and the stopper when the stopper is gripped between the stopper-gripping teeth; and the protrusion is positioned such that it may be received in the wire eye when the stopper-gripping teeth are pressed into gripping engagement with the stopper, such that pivoting the tool about the engaged teeth tensions the twisted portion, by which action the wire band is either broken or pried over the neck ring, thus releasing the wire band while the stopper-gripping portions remain engaged with the stopper and thereby allowing the wire cage and stopper to be subsequently removed together simultaneously.

According to still another aspect of the present invention there is provided a method of removing a stopper from a pressurised vessel of the type where the stopper is retained by a wire cage, the wire cage including a wire band engaging a neck ring on the vessel, the wire band being secured by a twisted portion terminating in a wire eye, the method including:

providing tool with a pair of elongate members pivotally connected together, each member having a handle portion and a jaw portion, each jaw portion having a stopper-gripping portion on an inner side thereof for gripping the stopper; each tool further including a protrusion fixed to at least one of the jaw portions and adapted to be received in the wire eye for tensioning the twisted portion;

passing the protrusion through the wire eye;

squeezing the handle portions together to engage the stopper-gripping portions with the stopper;

pivoting the tool about a fulcrum formed between the two stopper-gripping portions so as to tension the twisted portion and either break the wire band or pull the wire band over the neck ring, thus releasing the wire band while the stopper-gripping portions remain engaged with the stopper, and removing the stopper and wire cage together from the vessel.

The protrusion may be used to pierce a foil cap covering the wire and stopper, thus allowing the method to be used for removing the stopper without first removing the foil.

Preferably in manipulating the tool so as to tension the twisted portion and either break the wire band or pull the wire band over the neck ring the tool is pivoted about a fulcrum formed between the two stopper-gripping portions.

Preferably before removing the stopper and wire from the vessel, the method includes the further step of twisting the tool about a longitudinal axis of a passage in which the stopper is received to overcome any friction holding the stopper, thereby allowing the internal pressure to eject the stopper.

In addition to being engaged with the wire band, the stopper-gripping portion may also grip the wire, allowing the stopper, wire, and foil cap to be retained together in the stopper-gripping portion.

Advantageously the tool may be used for opening highly pressurised wine bottles, such Champagne wine bottles and the like. This tools is effective and efficient in use, protecting surrounding people and objects from flying stoppers by retaining the stopper in the tool, while also allowing stoppers to be simply and quickly removed. The tool may be economically constructed and has an overall simple design which minimizes manufacturing costs.

BRIEF DESCRIPTION OF DRAWINGS

Further aspects of the present invention will become apparent from the following description which is given by way of example only and with reference to the accompanying drawings in which.

DETAILED DESCRIPTION

Figure 1A:
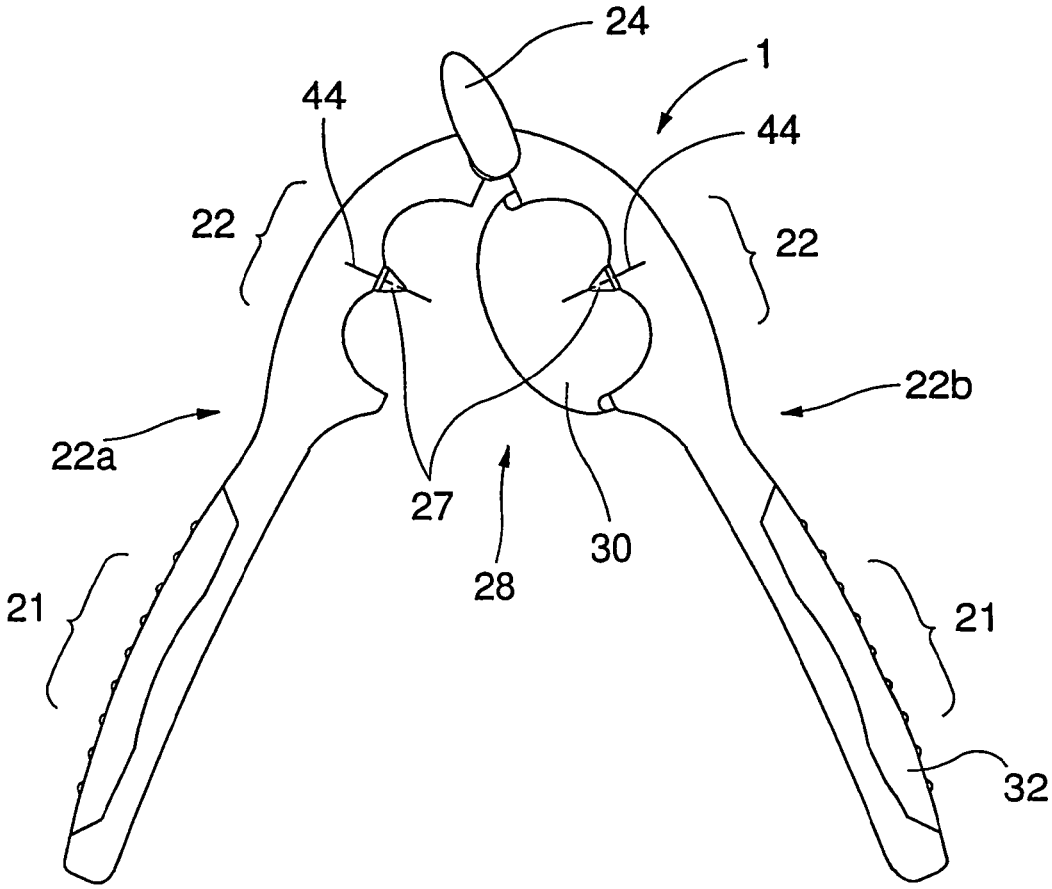
FIG. 1*a* is a view from below of a first preferred embodiment of the tool of the present invention in an open position.
Figure 1E:
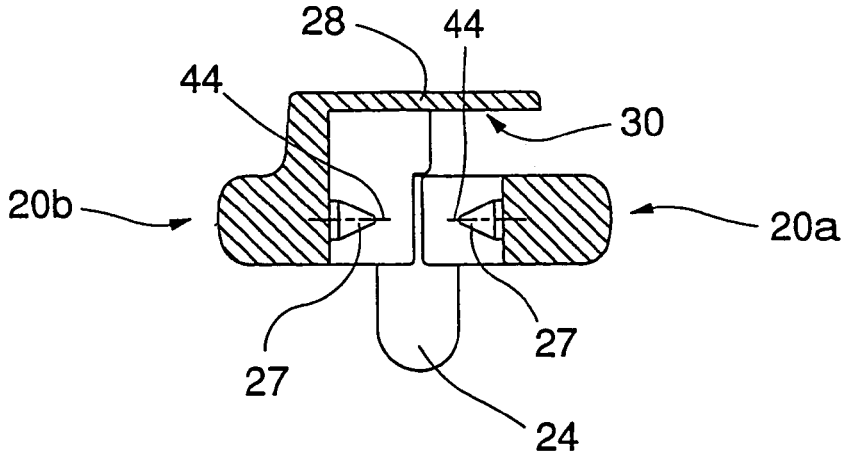
FIG. 1*e* is section XX from FIG. 1*c;*
Figure 1B:
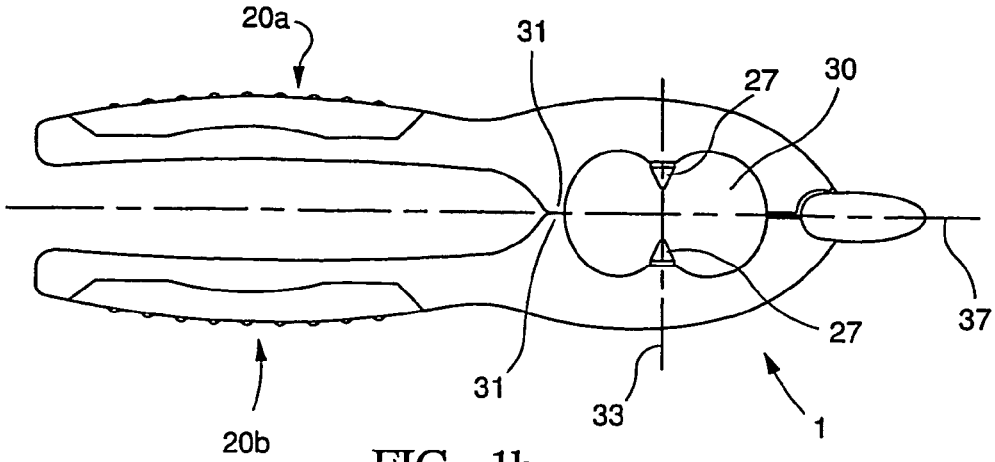
FIG. 1*b* is a view from below of the tool of FIG. 1*a* in a closed position.
Figure 1C:
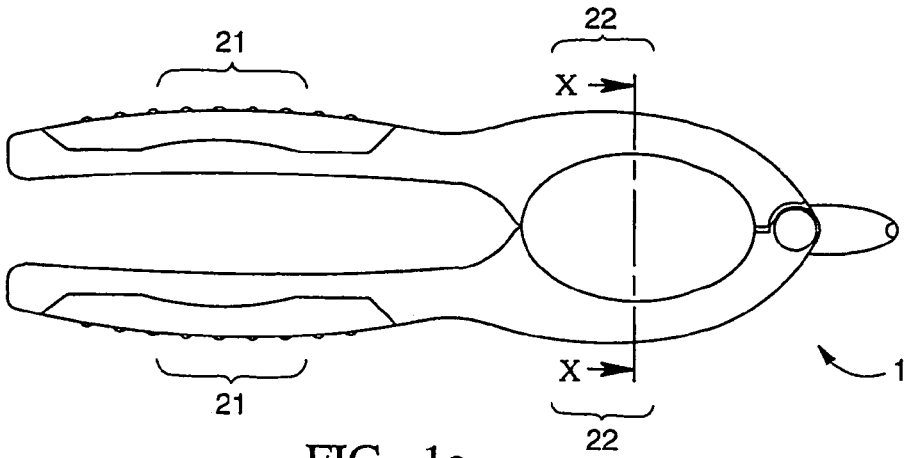
FIG. 1*c* is a view from above of the tool of FIG. 1*b;*
Figure 1D:
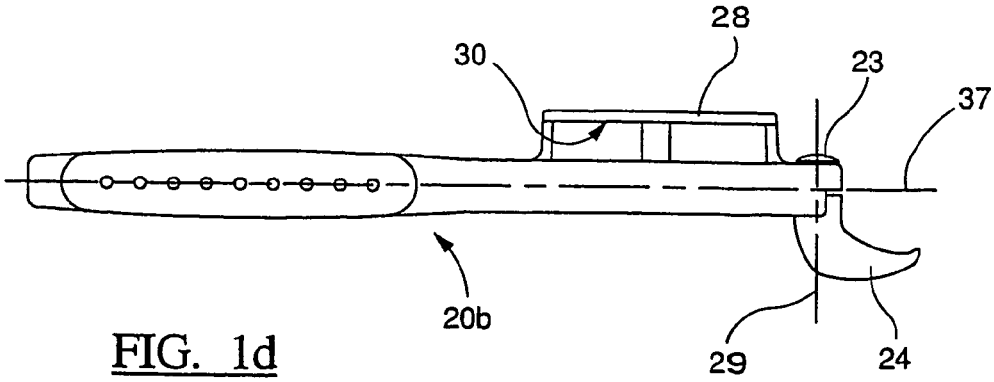
FIG. 1*d* is a side elevation of the tool of FIG. 1*a;*
Figure 2A:
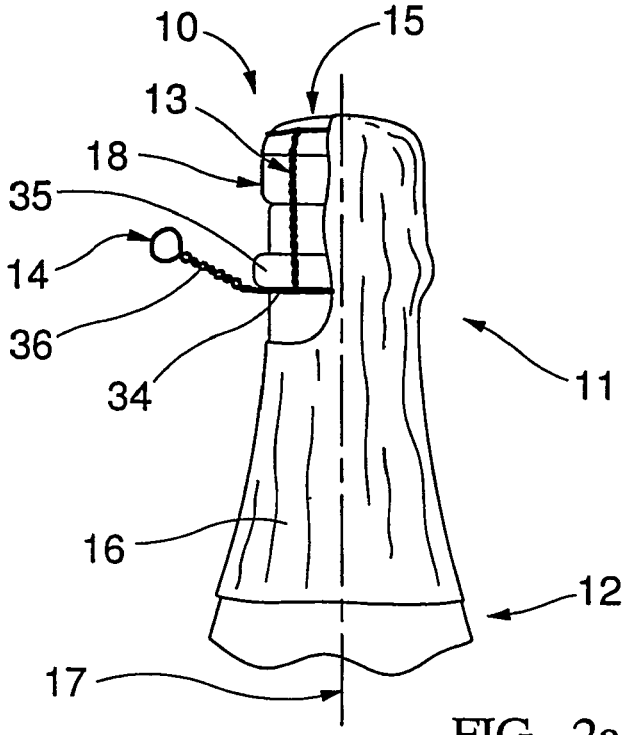
FIG. 2*a* is a part sectional view of a sparkling wine bottle.

Referring to the drawings, a first preferred embodiment of the tool 1 of the present invention is illustrated in FIGS. 1*a*–1*e*, and 2*a*–2*d*. The tool 1 is used for quickly, simply and safely removing a stopper 10, from the neck 11 of a pressurised vessel such as a sparkling wine bottle 12 (as illustrated in FIG. 2*a*). As is typical of bottles of this type the stopper 10 is retained by a wire cage 13 secured by a band 34 below the neck ring 35 by a twisted portion 36 terminating in a wire eye 14. The neck 11 has a longitudinal axis 17. The wire cage 13 is covered by a foil cover 16. The head of the stopper 10 protrudes from the end of the neck 11 and had side faces 18 elongated in the direction of the longitudinal axis 17 and an outermost or end face 15 generally opposing the opening end of the neck.

As best seen in the FIG. 1*a*–1*c*, this preferred embodiment of the tool 1 generally includes a pair of elongate members 20*a*, 20*b* comprising first member 20*a* and second member 20*b*. The two members 20*a*, 20*b* are generally alike in size, each member having an elongate handle portion 21 at one end and a jaw portion 22 with a gripping tooth 27 at the opposing end. The two members 20*a*, 20*b* are connected at their ends by a pivot pin 23 to pivot about a pivot axis 29 between an open position and a closed position. A protrusion or hook 24 may be fixed to either jaw portion 22, but in the embodiment illustrated is fixed to member 20*b*.

The teeth 27 have a conical surface for engaging the stopper 10 when the jaw portions 22 are pivoted to the closed position to close around the stopper 10. When the handle portions 21 are squeezed together to grip the stopper in the jaw portions 22, the teeth 27 cooperate to form a fulcrum about which relative pivoting movement is permitted between the tool 1 and the stopper 10. As shown in FIG. 1*b*, in the closed position, the teeth 27 are generally aligned to provide a fulcrum axis 33 about which the tool 1 can rotate. The hook 24 is offset from the fulcrum axis 33 and the fulcrum axis is substantially perpendicular to the longitudinal axis 37 of the members 20*a*, 20*b* to avoid twisting the tool when it is used. While each tooth 27 is symmetrical about a respectively inwardly directed axis 44, it will be appreciated that the axes 44 need not be aligned to provide the fulcrum and the tool can be satisfactorily used on stoppers of different diameters.

Each jaw portion 22 are separated from the handle portion 21 by a stop 31. As seen in FIG. 1*b*, the stops 31 abut to limit the closing movement of the members 20*a*, 20*b*. The tool 1 further includes an abutment flange 28 which, in the preferred embodiment shown, is formed on the member 20*b*. The abutment flange 28 extends inwardly with respect to the jaw portions 22 and provides an abutment surface 30 for abutting the end face of the stopper 10.

The hook 24 is elongated generally in the direction of the longitudinal axis 37 of the members 20*a*, 20*b*. The hook 24 tapers from a pointed tip 38 to the point it is fixed to the member 20*b*. The tip 38 is turned inwardly toward the abutment surface 30.

The members 20*a*, 20*b* may be moulded metal or plastic components and the handle portions 21 may include grips 32 of elastomeric material for improved ergonomics.

Figure 2B:
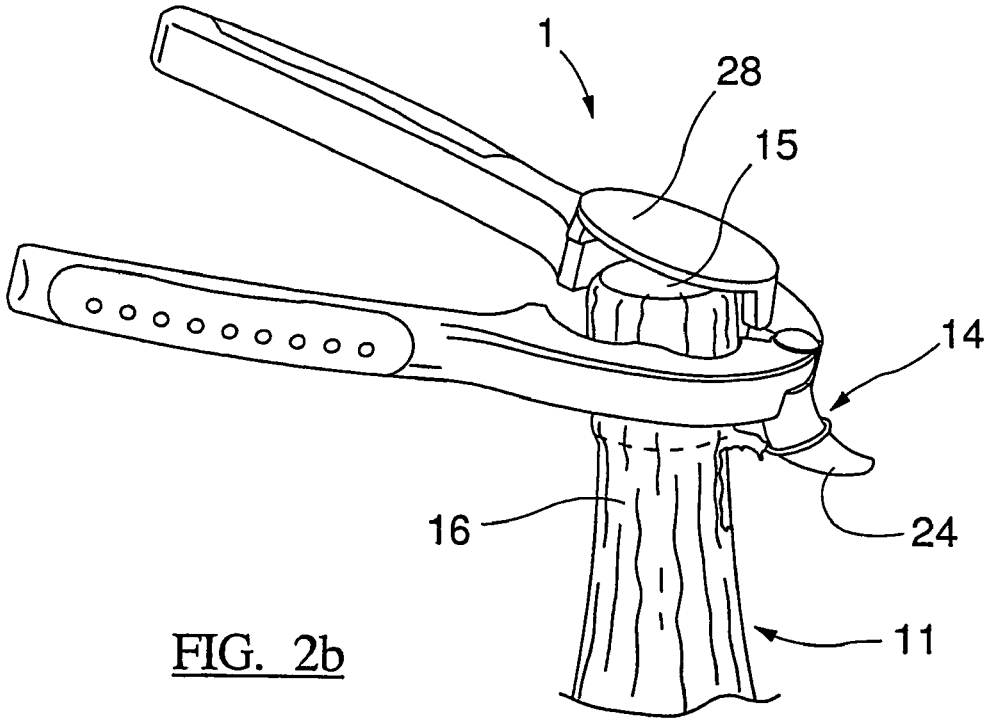
FIGS. 2*b*, 2*c* and 2*d* are pictorial views showing a first, second and third steps respectively in the use of the tool of FIG. 1*a* to remove a stopper.
Figure 2C:
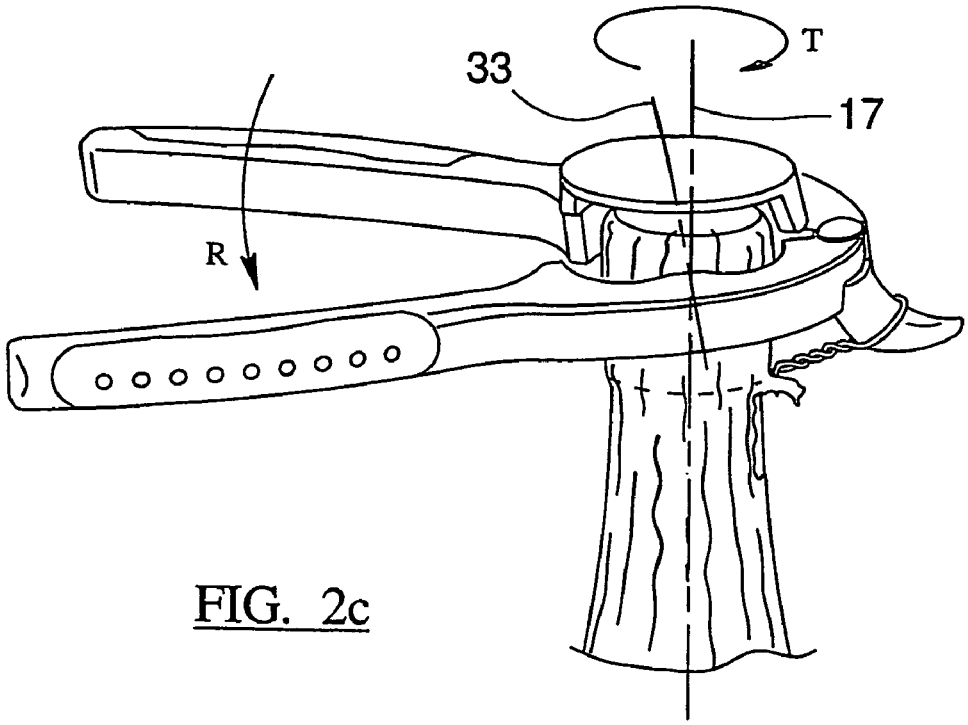
Figure 2D:
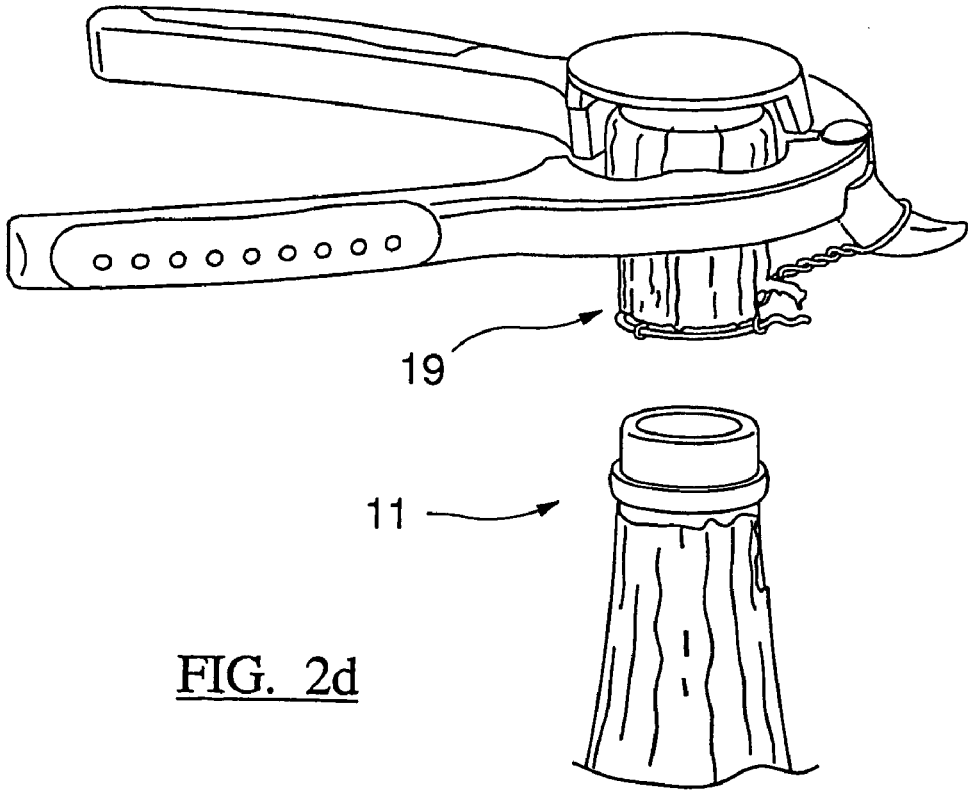
Figure 3A:
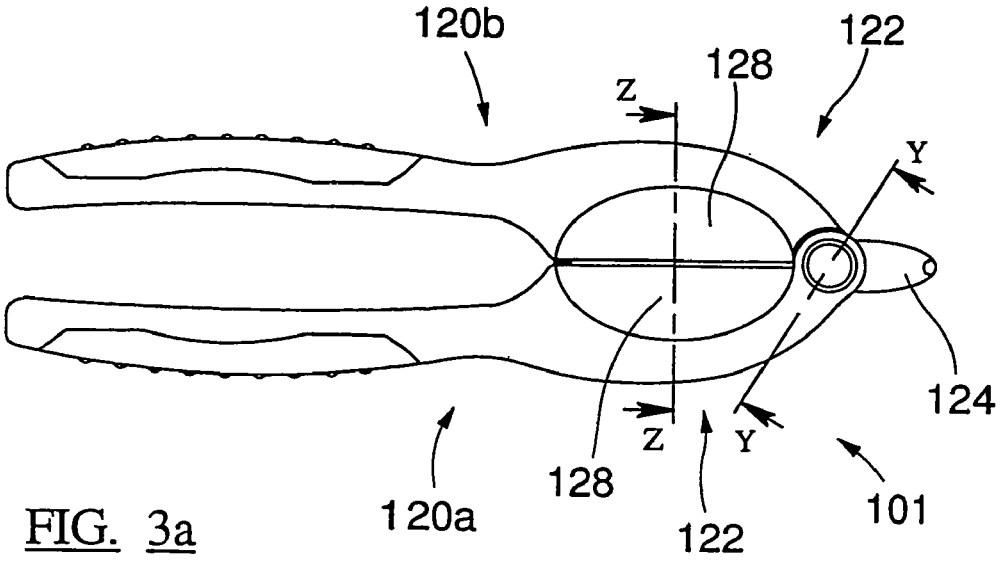
FIG. 3*a* is a view from above of a second preferred embodiment of the tool of the present invention.
Figure 3B:
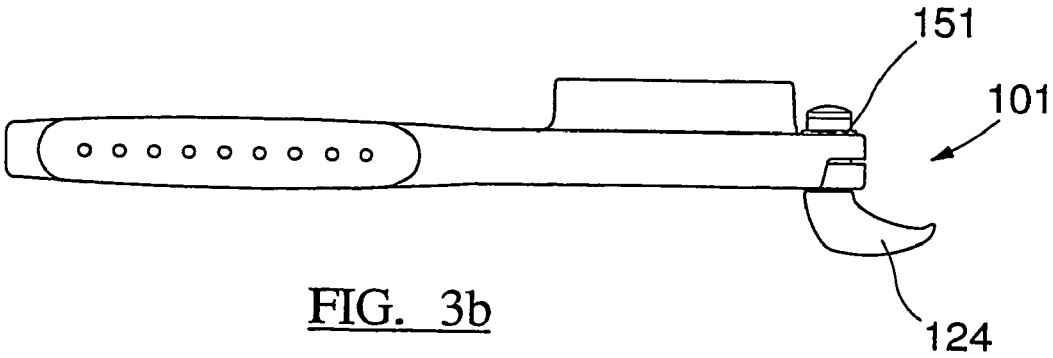
FIG. 3*b* is a side elevation of the tool of FIG. 3*a* showing the hook extended.
Figure 3C:
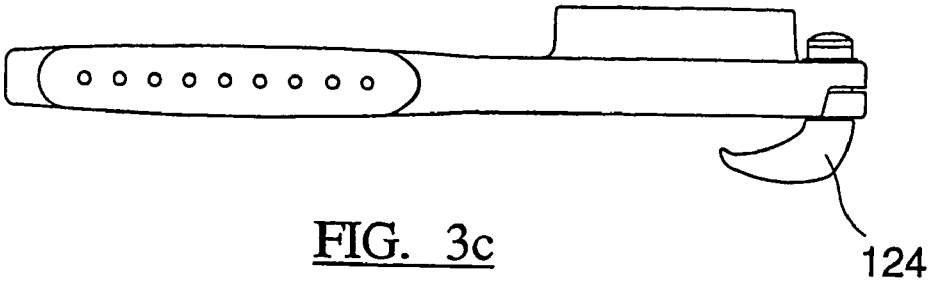
FIG. 3*c* is a side elevation of the tool of FIG. 3*a* showing the hook retracted.
Figure 3D:
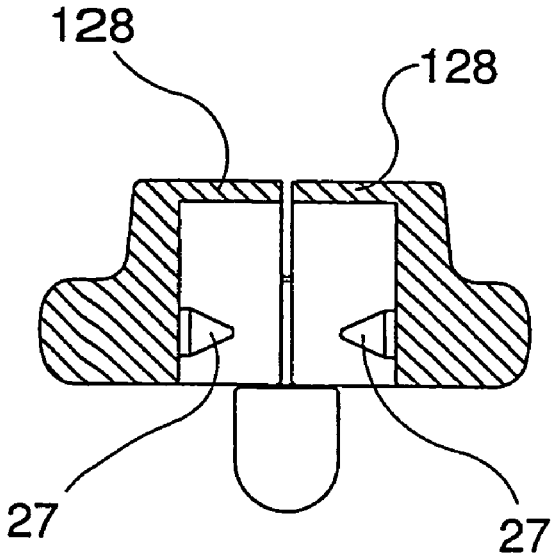
FIG. 3*d* is section YY from FIG. 3*a*.
Figure 3E:
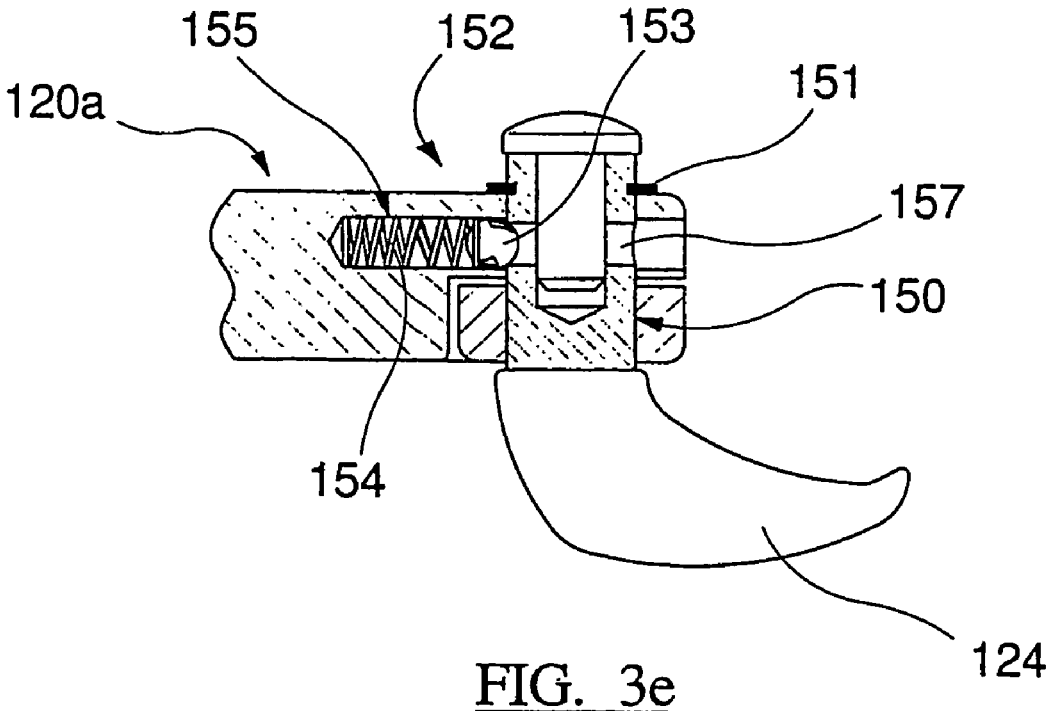
FIG. 3*e* is section ZZ from FIG. 3*a*

Referring to FIGS. 2*b*–2*c*, in use, with one hand holding the bottle 12 and the other manipulating the tool 1, the hook 24 is pressed into the eye 14, piercing the foil cap 16 covering the wire 13 as necessary. The tip is preferably pressed through the foil outside but immediately adjacent the wire eye 14, then under one side and out through the centre of the wire eye 14, thereby avoiding untwisting of the twisted portion 36.

The handle portions 21 are then manipulated to open the jaw portions 22 which are lowered until the end face 15 of the stopper 10 abuts the surface 30 and the jaw portions 22 surround the head 10 the stopper 10 (see FIG. 2*b*). The handle portions 22 are then squeezed together to press the teeth 27 into the side faces 18 of the stopper 10.

With the tool 1 engaged in this manner, the user next pivots the tool 1 relative to the bottle 12 in direction R about the fulcrum formed between the engaged teeth 27 (i.e. about fulcrum axis 33 which is generally perpendicular to the longitudinal axis 17) to tension and either break the band 34 or move/pry the band 34 over the neck ring 35 (see FIG. 2*c*) This pivoting movement is best done by a sharp downward movement of the handle portions 21. It will be understood that untwisting the twisted portion 36 is to be avoided since it lengthens the twisted portion 36 with a consequent risk that, when the tool 1 is pivoted in this manner, the stops 31 will strike and perhaps damage the rim of the bottle 12.

Finally, while still gripping the stopper 10, a light twist of the tool 1 about the axis 17 of the neck in direction T breaks the foil and overcomes any friction holding the stopper, allowing the internal pressure to assist in ejecting the stopper 10. As will be appreciated, the teeth 27, the hook 24 as well as the rest of the jaw portion 22 retain the wire cage 13, foil cap 16 and stopper 10 together in one piece 19.

The applicant has found through testing on sparkling wines from many producers that, in use, the band 34 is usually broken. Only very rarely is the band 34 pried over the neck ring 35. The latter typically occurs when the band 34 is made of a poor quality ductile wire or when the user is over cautious and the downward pivoting movement of the handle portions 21 is not sufficiently sharp, thereby allowing the wire to stretch rather than break.

A second preferred embodiment of the tool 101 is illustrated in FIGS. 3*a*–3*e* and is adapted to be carried in the user's pocket. It differs from the first embodiment in the construction of the hook 124, the joining of the members 120*a*, 120*b* and abutment flanges 128, but is otherwise generally of like construction. The hook 124 is pivotally fixed, allowing it to be pivoted from the extended position (FIG. 3*b*) where it extends from the end of the members 120*a*, 120*b* in the elongate direction and may be used, to the retracted position (FIG. 3*c*) by turning the hook 124 through approximately 180'. In this manner the tool may be put in the retracted position when not in use e.g. allowing it to be carried in the user's pocket without causing damage. While it will be appreciated that the hook could be fixed for pivoting in many ways, as illustrated the hook 124 has a shaft portion 150 received in an aperture in the members 120*a*, 120*b* and fixed by a retaining ring or circlip 151. The members 120*a*, 120*b* are pivotally connected by the shaft portion 150. A spring-loaded ball type detent 152 is provided to hold the hook 124 in both the extended and retracted positions and engages in recesses in the shaft portion 150. The detent 152 includes a ball 153 and spring 154 held in a recess 155 to member 120*a*.

The tool 101 also differs from the first embodiment in the construction of the abutment flanges 128, which are fixed to each end of the members 120*a*, 120*b*. When the jaw portions 122 are closed (FIG. 3*a*) or partially closed, both abutment flanges 128 provide respective generally coplanar surfaces 130 for abutting the top of the stopper 10. The tool 101 is used in the same manner as described above, but of course the hook 124 is pivoted to its extended position before use and after use i may be retracted.

Aspects of the present invention have been described by way of example only and it should be appreciated that modifications and additions may be made thereto without departing from the scope of the appended claims.

The invention claimed is:

1. A hand tool capable of removing a stopper from a pressurized vessel of a type where the stopper is retained by a wire cage, the wire cage including a wire band at or adjacent a neck ring on the vessel, the wire band being secured by a twisted portion terminating in a wire eye, the tool including:

a pair of elongate members pivotally connected together, each member having a handle portion and a jaw portion;

a stopper-gripping portion on an inner side of each jaw portion, the stopper-gripping portions, in use, able to effectively grip the stopper therebetween and cooperate to permit relative pivoting movement between the members and the stopper substantially about a fulcrum axis defined by and extending between the two stopper-gripping portions, and the tool having a protrusion at or adjacent at least one of the members and adapted to be received in the wire eye when the stopper-gripping portions are engaged with the stopper.

2. The tool of claim 1 wherein the protrusion is offset from the stopper-gripping portions such that with the protrusion received in the wire eye and the stopper-gripping portions engaged with the stopper, pivoting the tool about the stopper-gripping portions tensions the twisted portion, by which action the wire band is either broken or moved over the neck ring, thus releasing the wire band while the stopper-gripping portions remain engaged with the stopper and thereby allowing the wire cage and stopper to be subsequently removed simultaneously.

3. The tool of claim 1, wherein the protrusion is offset from the stopper-gripping portions such that with the protrusion received in the wire eye and the stopper-gripping portions engaged with the stopper, pivoting the tool about the stopper-gripping portions tensions the twisted portion, by which action the wire band is either broken or moved over the neck ring, thus releasing the wire band while the stopper-gripping portions remain engaged with the stopper and thereby allowing the wire cage and stopper to be subsequently removed simultaneously, and wherein each stopper-gripping portion has a stopper-engaging surface which is symmetrical about an inwardly directed axis.

4. The tool of claim 1, wherein the protrusion is offset from the stopper-gripping portions such that with the protrusion received in the wire eye and the stopper-gripping portions engaged with the stopper, pivoting the tool about the stopper-gripping portions tensions the twisted portion, by which action the wire band is either broken or moved over the neck ring, thus releasing the wire band while the stopper-gripping portions remain engaged with the stopper and thereby allowing the wire cage and stopper to be subsequently removed simultaneously, and wherein each stopper-gripping portion comprises a tooth.

5. The tool of claim 1, wherein the protrusion is offset from the stopper-gripping portions such that with the protrusion received in the wire eye and the stopper-gripping portions engaged with the stopper, pivoting the tool about the stopper-gripping portions tensions the twisted portion, by which action the wire band is either broken or moved over the neck ring, thus releasing the wire band while the stopper-gripping portions remain engaged with the stopper and thereby allowing the wire cage and stopper to be subsequently removed simultaneously, and wherein the protrusion is an elongate pointed hook that extends or is able to extend substantially parallel to an elongate axis of the members.

6. The tool of claim 1, wherein the protrusion is offset from the stopper-gripping portions such that with the protrusion received in the wire eye and the stopper-gripping portions engaged with the stopper, pivoting the tool about the stopper-gripping portions tensions the twisted portion, by which action the wire band is either broken or moved over the neck ring, thus releasing the wire band while the stopper-gripping portions remain engaged with the stopper and thereby allowing the wire cage and stopper to be subsequently removed simultaneously, and wherein the protrusion is an elongate pointed hook that extends or is able to extend substantially parallel to an elongate axis of the members, and wherein the fulcrum axis extends substantially perpendicular to an elongate axis of the handle portions.

7. The tool of claim 1, wherein the protrusion is offset from the stopper-gripping portions such that with the protrusion received in the wire eye and the stopper-gripping portions engaged with the stopper, pivoting the tool about the stopper-gripping portions tensions the twisted portion, by which action the wire band is either broken or moved over the neck ring, thus releasing the wire band while the stopper-gripping portions remain engaged with the stopper and thereby allowing the wire cage and stopper to be subsequently removed simultaneously, and wherein the handle portions and protrusion are offset such that pressing down on the handle portions raises the protrusion.

8. The tool of claim 1, including at least one abutment surface able to abut an end face of the stopper when the tool is in use.

9. The tool of claim 1, wherein the pair of members are pivotally connected.

10. The tool of claim 1, wherein the protrusion is fixed to at least one of the jaw portions.

11. The tool of claim 1, wherein the protrusion is fixed to at least one of the jaw portions, and wherein the protrusion is pivotally mounted for movement between an extended and a retracted position.

12. A hand tool for removing a stopper from a sparkling wine bottle where the stopper is retained by a wire cage, the wire cage including a wire band at or adjacent a neck ring on the bottle, the wire band being secured by a twisted portion terminating in a wire eye, the tool allowing the wire band to be released while maintaining gripping engagement with the stopper, the tool including:

a pair of elongate members pivotally connected together, each member being substantially rigid and formed in one piece having a handle portion and a jaw portion at opposing ends thereof each of the jaw portions having a stopper-gripping tooth and at least one of the jaw portions having a protrusion which does or which can extend therefrom, wherein each stopper-gripping tooth is on an inner side of each respective jaw portion for engagement with the stopper, the stopper-gripping teeth able to cooperate to permit relative pivoting movement between the jaw portions and the stopper when the stopper is gripped between the stopper-gripping teeth; and the protrusion is positioned such that it may be received in the wire eye when the stopper-gripping teeth are pressed into gripping engagement with the stopper, such that pivoting the tool about the teeth tensions the twisted portion, by which action the wire band is either broken or moved over the neck ring, thus releasing the wire band while the stopper-gripping portions remain engaged with the stopper and thereby allow the wire cage and stopper to be subsequently removed together simultaneously.

13. A method of removing a stopper from a pressurised vessel of a type where the stopper is retained by a wire cage, the wire cage including a wire band at or adjacent a neck ring on a vessel, the wire band being secured by a twisted portion terminating in a wire eye, the method including:

providing a tool with a pair of elongate members pivotally connected together, each member having a stopper-gripping portion on an inner side thereof for gripping the stopper; the tool further including a protrusion at or adjacent one of the stopper-gripping portions and adapted to be received in the wire eye for tensioning the twisted portion;

passing the protrusion though the wire eye;

squeezing the elongate members together to engage the stopper-gripping portions with the stopper;

pivoting the tool about a fulcrum formed between the two stopper-gripping portions so as to tension the twisted portion and either break the wire band or pull the wire band over the neck ring, thus releasing the wire band while the stopper-gripping portions remain engaged with the stopper, and removing the stopper and wire cage together from the vessel.

14. The method of claim 13 including the further step of twisting the tool about a longitudinal axis of a passage in which the stopper is received to at least partially overcome any friction holding the stopper, thereby allowing the internal pressure to assist in ejecting the stopper.

* * * * *